US005427576A

United States Patent [19]

Pfeiffer

[11] Patent Number: 5,427,576

[45] Date of Patent: Jun. 27, 1995

[54] BUNGY JUMPING TOWER

[75] Inventor: Otto Pfeiffer, Runaway Bay, Australia

[73] Assignee: Redara Pty Ltd, Australia

[21] Appl. No.: 917,036

[22] PCT Filed: May 7, 1992

[86] PCT No.: PCT/AU90/00206

§ 371 Date: Jun. 21, 1993

§ 102(e) Date: Jun. 21, 1993

[87] PCT Pub. No.: WO92/20612

PCT Pub. Date: Nov. 26, 1992

[30] Foreign Application Priority Data

May 10, 1991 [AU] Australia ..... PK6065

[51] Int. Cl.[6] ..... A63J 5/12

[52] U.S. Cl. ..... 472/136; 472/50; 472/133; 472/131

[58] Field of Search ..... 472/49, 50, 135, 136, 472/131, 137; 182/101, 102, 103; 52/116, 117, 119, 120

[56] References Cited

U.S. PATENT DOCUMENTS

| | | | |
|---|---|---|---|
| 279,545 | 6/1883 | Dempster et al. | 182/102 |
| 3,592,294 | 7/1971 | Allen | 182/103 |
| 4,546,854 | 10/1985 | Böcker | 182/103 |
| 5,203,744 | 4/1993 | Checketts | 472/137 |

FOREIGN PATENT DOCUMENTS 4862890 8/1990 Australia .

*Primary Examiner*—Carl D. Friedman
*Assistant Examiner*—Kien Nguyen
*Attorney, Agent, or Firm*—Renner, Otto, Boisselle & Sklar

[57] ABSTRACT

A bungy jumping tower (10) is disclosed having an elongated boom (11) arranged at an inclined angle relative to the ground, The boom (11) has at least one guide (45). A carriage (29) provides a platform from which a jumper may launch himself. The carriage is driven along the guide for movement between a raised and a lowered position.

8 Claims, 2 Drawing Sheets

BUNGY JUMPING TOWER

FIELD OF THE INVENTION

This invention relates to a bungy jumping tower.

BACKGROUND OF THE INVENTION

The sport of bungy jumping has in recent years become a popular recreational pastime. This sport involves a tethered free fall from a height of about 40 or 50 meters with the feet of the jumper tied with an elastic cord or rope and anchored so that the fall is arrested by the cord just short of the ground. The fall, once arrested results in a rebound of considerable distance and is followed by oscillations of decreasing magnitude.

Bungy jumping can be conducted from fixed structures such as buildings or bridges. This is considered undesirable and not condoned by authorities. Bungy jumping can also be conducted from cliffs or the like. It is usual for ramps or overhangs to be necessary as launching platforms to ensure that the jumper does not contact the rise of the cliff during the rebound and oscillation phase of the lump. For such jumping to be conducted on a commercial scale it was necessary to provide some means to enable the jumper to readily travel from where the jump terminates back to the ramp or overhang to conduct another jump. Stairs were typically provided and where the height of the jump was about 50 meters, climbing of the stairs was a strenuous and tedious exercise.

It is also known to bungy jump from hot air balloons. Balloons have not provided a commercially viable bungy jumping station, For each jump it was necessary to ground the balloon and then rise again into the air for the requisite height or to carry a number of jumpers on one flight. It was possible for multiple jumps to be carried out from a balloon without grounding but then ballasting the balloon to maintain a steady height became difficult to achieve.

It is known to employ cranes for bungy jumping. The jib of the crane was maintained at a constant inclination and a cage was employed to hoist the jumper and instructor or jump master and other personnel. The jumper would launch himself from the cage and the crane would be slewed and the cage lowered to enable the jumper to be lowered to the ground, released and another jumper collected and lifted to the requisite height for a jump. The use of cranes required skilled crane operators and typically unions specified that two such operators were to drive each crane for set periods of time to ensure that operator fatigue or stress did not result.

Cranes were either purchased outright and then dedicated to the bungy jumping operation or were simply leased or hired. In all of these situations the cost involved was considerable and this was reflected in the cost per jump levied by operators.

It is an object of the present invention to provide a bungy jumping tower which at least minimises the disadvantages referred to above.

DISCLOSURE OF THE INVENTION

According to an aspect of the invention there is provided a bungy jumping tower including an elongated boom extending at an inclined angle relative to the ground, at least one guide extending along the boom, a carriage providing a platform from which a jumper may launch himself for a jump, the carriage being adapted for movement along the guide between a raised and a lowered position and a drive for moving the carriage between its positions.

Although any suitable angle of inclination for the boom may be adopted, it is preferred that the boom have a length and be inclined to provide an unimpeded jump zone adjacent the boom. Preferably, the boom is inclined at an angle of about 60 degrees to the horizontal although lesser or greater angles may be employed provided the requisite safe jump zone is provided adjacent the boom.

The boom may have any suitable length. Preferably the boom has a length which affords a jump height of about 47 meters is desired although greater or lesser lengths may be employed.

The boom may be constructed as a space frame from, a plurality of members secured together in any suitable way such as by welding or fasteners.

Preferably the boom is supported in its inclined position by a plurality of supports. The supports, in one embodiment, may comprise guy wires or stays. The stays may be secured to extend between the boom and anchor points on the ground. The boom is mounted to the ground or other suitable base. Footings may be used for this purpose.

Preferably two guides are present. Thus guides may be spaced from one another and extend a substantial distance along the boom. The guides may be channel shaped and be adapted to receive guide members extending from the carriage. The channels are preferably oppositely directed U shaped channels. The channels are preferably outwardly directed. The guide members may be slides or rollers. Preferably guide rollers are employed. The guide rollers may be arranged in opposed pairs.

The drive may include a chain or cable drive although a drive such as a rack and pinion or hydraulic drive may also be used. Preferably the drive includes a cable and winch. A motor may be used to operate the winch. The cable is secured to the carriage and is wound onto and unwound from the winch to move the carriage between its positions. The winch includes at least one brake and a drive motor. The motor may be an electric motor. A gearbox may also be present.

DISCLOSURE OF THE DRAWINGS

A particular preferred embodiment of the invention will now be described with reference to the drawings in which.

DETAILED DESCRIPTION OF THE DRAWINGS

Figure 1:
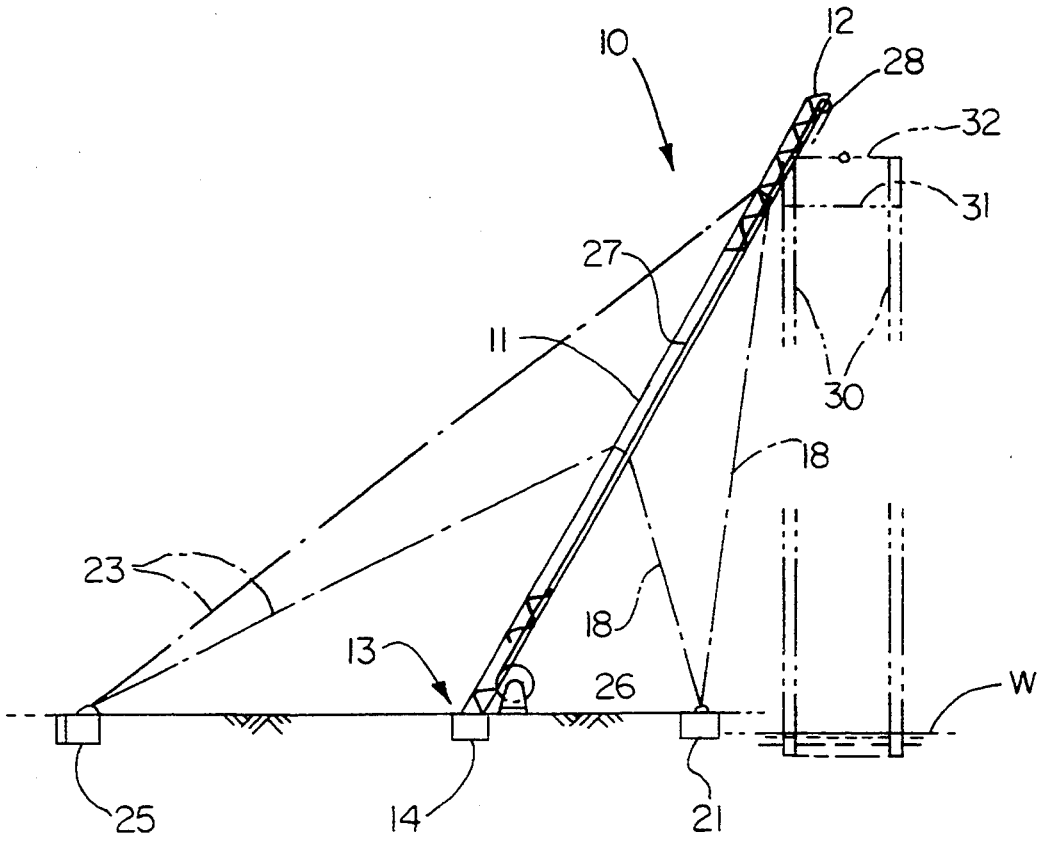
FIG. 1 is a schematic side elevational view of the bungy jumping tower according to an embodiment of the invention.
Figure 2:
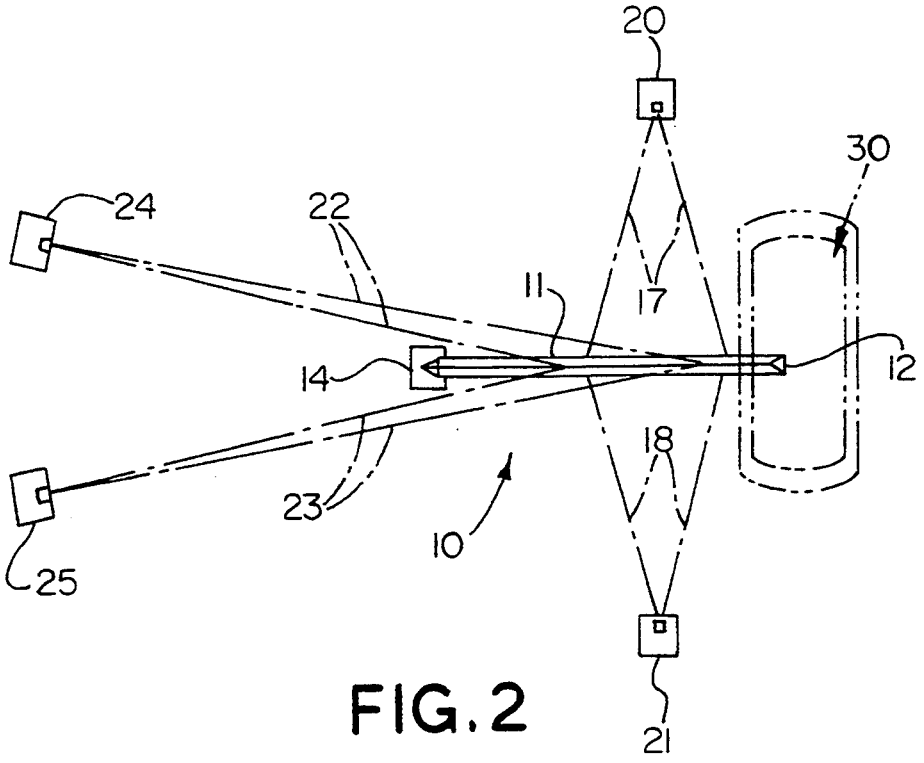
FIG. 2 is a plan view of the tower of FIG. 1.

FIGS. 1 and 2 show views of the bungy jumping tower 10. The tower has a boom 11 having an upper free end 12 and a lower end 13 secured to footing 14. The boom 11 is supported by opposed pairs of forwardly positioned stay wires 17, 18. Wires 17 are mounted to a footing 20 while wires 18 are mounted to footing 21. The boom is further supported by opposed pairs of rearwardly positioned stay wires 22, 23. Wires 22 are mounted to footing 24 while wires 23 are mounted to footing 25.

The tower 10 includes a motor driven winch 26 and a cable 27. The cable 27 extends along the boom 11 and over a pulley 28 adjacent end 12 of the boom. The cable is secured to a carriage 29 (shown in FIG. 3). Chain dotted line 30 defines a jump zone while the space between lines 30 and 31 is representative of a safety space extending around zone 30. The space between lines 32, 31 is representative of a top safety space. The boom 11 is shown at an angle of 60 degrees to the horizontal. Water W is illustrated immediately below end 12 of the boom. Instead of having the boom project over water, solid ground may be present below end 12. A platform, pontoon or solid ground is provided between footings 20, 21, the jump zone and end 13 of the boom to provide a drop off zone for jumpers.

Figure 3:
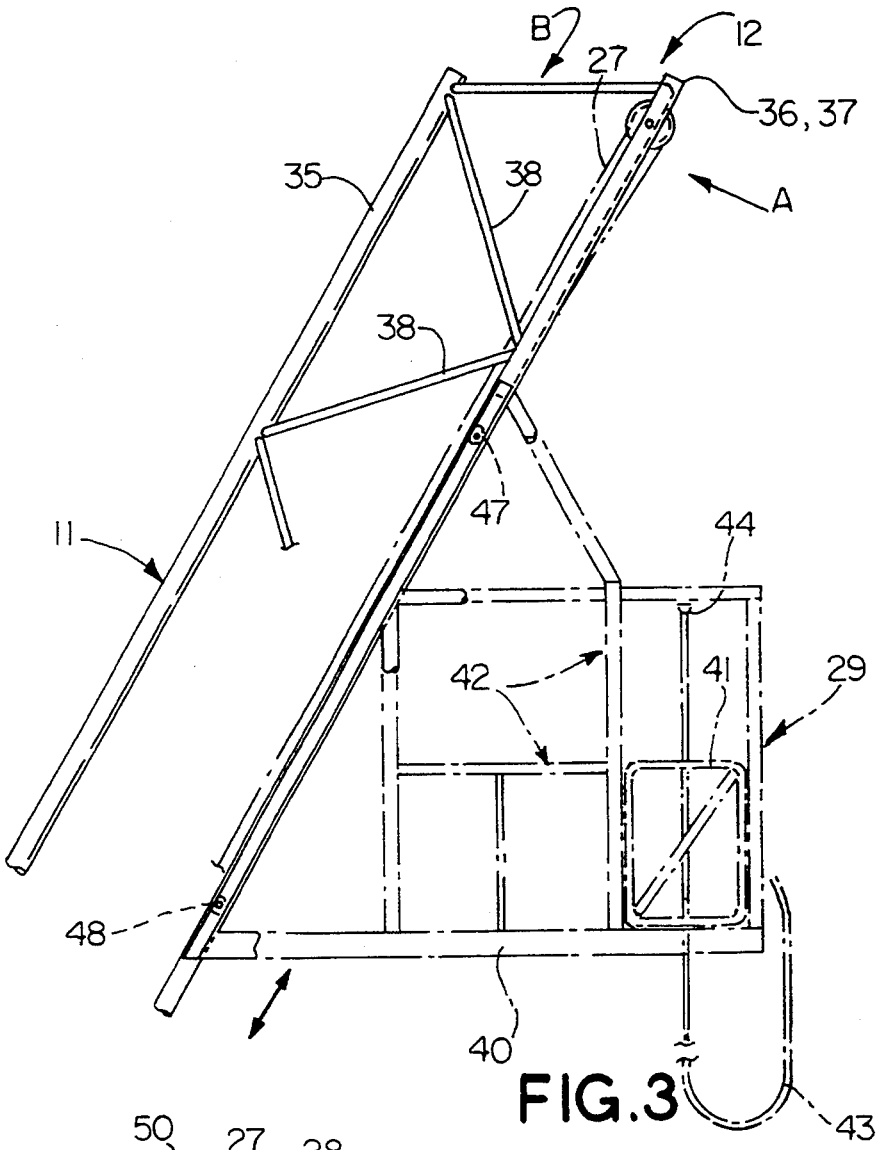
FIG. 3 is a fragmentary side view of a portion of the tower of FIG. 1.
Figure 5:
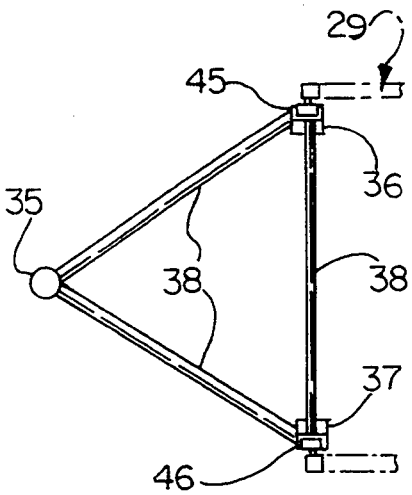
FIG. 5 is a view of the tower taken in the direction of arrow 13 in FIG. 3.

FIGS. 3 and 5 show detail of end 12 of boom 11. The boom 11 consists of a space frame having longitudinally extending members 35, 36 and 37 between which extend struts 38. Pulley 28 is mounted between members 36 and 37 and the cable 27, which extends over it is secured to carriage 29.

Carriage 29 is in the form of a cage having a floor 40, gate 41 and a cage structure 42. Bungy cord or rope 43 is secured to the cage structure at 44 and extends through a hole in floor 40. The rope 43 typically includes an elastic section and various shackles and fittings (not shown). The free end of rope 43 would be secured to the legs of the jumper who would stand on floor 40 and below location 44. Gate 41 enables one jumper to launch himself off the tower 10.

Guides 45, 46 in the form of channels extend along members 36, 37 and receive guide rollers 47, 48 which are mounted to the carriage.

Although an upper and a lower pair of guide rollers are shown, further such rollers may also be present.

Figure 4:
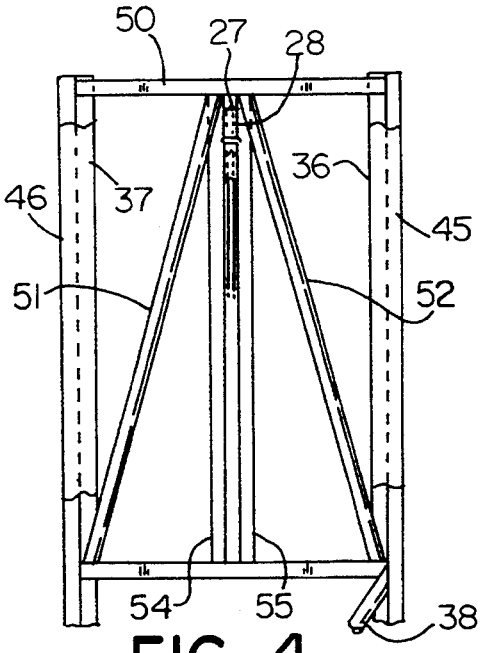
FIG. 4 is a view of the tower taken in the direction of arrow A in FIG. 3.

FIG. 4 shows the manner in which pulley 28 is mounted. Horizontal members 50 extend between members 36, 37. Inclined struts 51, 52 extend between member 50 and a spaced horizontal member 53. Pulley is mounted between longitudinally extending frame members 54, 55.

In use the winch 26 is operated to move the carriage between an elevated position and a lowered position. In the lowered position the carriage may rest on the ground rearwardly of the drop zone previously mentioned. A jumper and jump master may enter the carriage and be elevated to the required jump height. During this movement or at some other stage the bungy rope can be secured to the legs of the jumper. The jumper may launch himself from the carriage once it has reached the jump height. Once the rebound and oscillations to which the jumper are subjected to have subsided to a sufficient degree the carriage may be moved to its lowered position without stopping. This causes the jumper to be lowered onto the drop off zone and the carriage continues to move downwardly until it comes to rest rearwardly of the drop off zone.

The carriage can be controlled from the ground and also from the carriage itself. An audio and video communication link is preferably established between the ground and the carriage.

The tower of the invention does not require skilled crane operators. The jumpers can be raised and lowered without the need for movement of the boom. By continuously lowering the carriage at constant speed the jumper can efficiently and safely be lowered after his jump is completed. The idle time for the tower between jumps is minimised because the jumper can be released from the bungy rope once he is positioned on the drop off zone even though the carriage may not yet have come to rest to receive another jumper. Also, the time it takes to raise the carriage can be gainfully employed to secure the bungy rope to the legs of the next jumper.

I claim:

1. A bungy jumping tower including an elongated boom extending at an inclined angle relative to the ground, at least one guide extending along the boom, a carriage providing a platform from which a jumper may launch himself for a jump, the carriage being adapted for movement along the guide between a raised and a lowered position, and a drive for moving the carriage between said raised and lowered positions, wherein the carriage comprises a cage having a floor and a gate through which the jumper may launch himself from the tower, and the tower furthest comprises a cord which extends through the floor and is anchored to the carriage at a location above the floor, whereby the jumper may be tethered to the carriage by the cord.

2. The tower of claim 1 including two pairs of opposed forwardly positioned stay wires extending between the tower and footings on the ground.

3. The tower of claim 1 including two pairs of opposed rearwardly positioned stay wires extending between the tower and footings.

4. The tower of claim 1 wherein said drive comprises a winch with a cable secured to the carriage and trained over a pulley located adjacent an upper end of the boom.

5. The tower of claim 1 wherein the boom is inclined at an angle of about 60° to the horizontal.

6. The tower of claim 1 wherein said at least one guide includes two said guides each guide comprising guide rails spaced from one another and extending a substantial distance along the boom.

7. The tower of claim 6 wherein the guide rails comprise outwardly directed channels for receiving guide members secured to the carriage.

8. The tower of claim 1 wherein the boom consists of a space frame having longitudinally extending members with struts extending between said longitudinally extending members defining a substantially triangular shape in transverse cross section.

* * * * *

UNITED STATES PATENT AND TRADEMARK OFFICE

CERTIFICATE OF CORRECTION

PATENT NO. : 5,427,576

DATED : June 27, 1995

INVENTOR(S) : Otto Pfeiffer

It is certified that error appears in the above-identified patent and that said Letters Patent is hereby corrected as shown below:

On the title page, item [86]:

At PCT No.:, change "PCT/AU90/00206" to --PCT/AU92/00206--.

item [87] PCT Pub. No.: change "WO92/20612 to --WO92/20613--.

At References cited, U.S. PATENT DOCUMENTS, add --

| | | |
|---|---|---|
| 4,706,779 | 11/87 | Bono |
| 2,905,272 | 9/59 | Lunn |
| 2,632,530 | 3/53 | Wagner --. |

At References cited, FOREIGN PATENT DOCUMENTS, add --

| | | |
|---|---|---|
| 1,453,594 | 10/76 | Great Britain |
| 3,412,559 | 4/85 | Germany |
| 760,234 | 2/34 | France |
| 499,020 | 5/17 | France |
| 6,621,286 | 5/87 | Australia --. |

UNITED STATES PATENT AND TRADEMARK OFFICE

CERTIFICATE OF CORRECTION

PATENT NO. : 5,427,576

DATED : June 27, 1995

INVENTOR(S) : Otto Pfeiffer

It is certified that error appears in the above-identified patent and that said Letters Patent is hereby corrected as shown below:

IN THE CLAIMS:

Claim 1, column 4, line 31, change "furthest" to --further--.

Signed and Sealed this

Sixteenth Day of January, 1996

Bruce Lehman

*Attest:*

BRUCE LEHMAN

*Attesting Officer*

*Commissioner of Patents and Trademarks*